US006460302B1

(12) United States Patent
Neuhaus, III et al.

(10) Patent No.: US 6,460,302 B1
(45) Date of Patent: Oct. 8, 2002

(54) FRAMEWORK-FREE BUILDING SYSTEM AND METHOD OF CONSTRUCTION

(75) Inventors: J. Victor Neuhaus, III, Hunt, TX (US); Peter Zosh, III, deceased, late of San Antonio, TX (US), by Marion C. Zosh, legal representative

(73) Assignee: Microstone Building Systems, L.L.C., San Antonio, TX (US)

( * ) Notice: Subject to any disclaimer, the term of this patent is extended or adjusted under 35 U.S.C. 154(b) by 0 days.

(21) Appl. No.: 09/490,505

(22) Filed: Jan. 25, 2000

Related U.S. Application Data

(60) Provisional application No. 60/117,115, filed on Jan. 25, 1999.

(51) Int. Cl.[7] ..... E04B 2/02

(52) U.S. Cl. ..... 52/261; 52/233; 52/405.1; 52/309.12; 52/741.41; 52/745.05; 106/724

(58) Field of Search ..... 52/261, 309.12, 52/309.16, 741.41, 381, 417, 577, 405.1, 782, 785, 233, 745.05; 106/724, 737, 823

(56) References Cited

U.S. PATENT DOCUMENTS

| | | | | |
|---|---|---|---|---|
| 3,254,464 A | | 6/1966 | Hoyt, Jr. | |
| 3,597,890 A | * | 8/1971 | Hala | 52/577 X |
| 3,676,973 A | | 7/1972 | Kellert | |
| 3,982,368 A | * | 9/1976 | Perrin | 52/381 |
| 4,067,164 A | | 1/1978 | McMillan | |
| 4,094,110 A | * | 6/1978 | Dickens et al. | 52/417 X |
| 4,150,175 A | | 4/1979 | Huettemann | |
| 4,253,288 A | * | 3/1981 | Chun | 52/309.12 X |
| 4,292,783 A | | 10/1981 | Mulvihill | |
| 4,342,180 A | | 8/1982 | Gibson et al. | |
| 4,505,449 A | | 3/1985 | Turner et al. | |
| 4,774,794 A | | 10/1988 | Grieb | |
| 4,788,803 A | * | 12/1988 | Seitz | 52/309.12 X |
| 4,827,690 A | * | 5/1989 | Viger | 52/577 X |
| 5,129,628 A | | 7/1992 | Vesper | |
| 5,184,808 A | | 2/1993 | Vesper | |
| 5,209,968 A | | 5/1993 | Sweeney | |
| 5,404,685 A | | 4/1995 | Collins | |
| 5,421,558 A | | 6/1995 | Vesper | |
| 5,509,640 A | | 4/1996 | Vesper | |
| 5,640,817 A | | 6/1997 | Bos | |
| 5,671,913 A | | 9/1997 | Vesper | |
| 5,687,956 A | | 11/1997 | Vesper | |
| 5,771,649 A | * | 6/1998 | Zweig | 52/309.12 |
| 5,803,964 A | | 9/1998 | Scarborough | |
| 5,809,717 A | | 9/1998 | Scarborough et al. | |
| 5,966,885 A | | 10/1999 | Chatelain | |
| 5,970,672 A | | 10/1999 | Robinson | |

OTHER PUBLICATIONS

Enerfoam and Enerbond, Material Safety Data Sheet, National Evaluation Service, Inc., Sep. 1, 1996, 4 pages.
Modified Expanded Polystyrene, Material Safety Data Sheet, Houston Foam Plastics, Sep. 20, 1996, pp. 1–4.
Fibermesh, Material Safety Data Sheet, Synthetic Industries, Inc., Jan. 22, 1997, pp. 1–2.
Microstone Sandwich Panel System, Material Safety Data Sheet, Celotex Corporation, Aug. 6, 1999, 1 page.
Expanded Polystyrene Insulation, Material Safety Data Sheet, Alamo Foam, Inc., pp. 1–2 (no date available).

* cited by examiner

*Primary Examiner*—Richard Chilcot
(74) *Attorney, Agent, or Firm*—Hollander Law Firm, P.L.C.

(57) ABSTRACT

An easily constructed and highly durable structure, and method of making the same. The structure is constructed of lightweight foam panels assembled into walls and a roof, and therefore requires no framework. The entire structure is then sprayed with a cementitious coating. The cementitious coating is applied directly to the foam panels, and dries with sufficient strength and durability to make the structure load-bearing.

54 Claims, 8 Drawing Sheets

FRAMEWORK-FREE BUILDING SYSTEM AND METHOD OF CONSTRUCTION

RELATED PATENT APPLICATIONS

This patent application claims priority to United States Provisional Application No. 60/117,115, filed Jan. 25, 1999, and entitled FRAMEWORK-FREE BUILDING SYSTEM AND METHOD OF CONSTRUCTION; said application in its entirety is hereby expressly incorporated by reference into the present application pursuant to 37 CFR 1.53(c).

BACKGROUND OF THE INVENTION

This invention relates to a foam panel building system that is bonded together with a sprayed-on cementitious coating that forms a load-bearing shell around the entire structure.

There are numerous methods for constructing homes and building structures, and each have their benefits and drawbacks. The most common home building method in the Unites States, for instance, involves building a wood frame structure, which is then faced with brick or siding of a variety of materials, and finished with drywall and paint on the interior. Building such a home takes considerable time, requires workers with a variety of skilled trades, and incorporates numerous different materials. While this building method is highly flexible, it is often quite costly.

The most common building method throughout the rest of the world involves building a structure with blocks made of a wide variety of materials, including mud, brick, or concrete. While relatively simple and inexpensive to construct, such building methods are time consuming, often require skilled laborers, and frequently require materials not readily available in every location.

There are many places in the world that are without the necessary building materials and skilled workers, and where the local population cannot afford to construct homes. Thus, there is a need throughout the world for buildings that are highly durable, yet quick, easy, and relatively inexpensive to construct. This invention meets that need by providing a structure that requires few components and is quick and simple to construct, resulting in a relatively inexpensive method of construction.

There are a number of patents covering lightweight foam panel buildings covered with cementitious material, but none have the features of this design. One of the earliest is U.S. Pat. No. 3,676,973, issued on Jul. 18, 1972 to Kellert, which contains an elaborate structural framework, and also requires a wire screen for application of sprayed on concrete. Another example is seen in U.S. Pat. No. 4,292,783, issued on Oct. 6, 1981 to Mulvihill, which requires the use of a temporary framework to assemble the panels, and then requires a rigid steel wire mesh for application of a gunite concrete layer. A third example, U.S. Pat. No. 4,342,180, issued Aug. 3, 1982 to Gibson et. al., requires a steel framework to hold the panels in place, and requires wire mesh for application of the concrete. The necessity of a framework, either temporary or permanent, increases the cost and complexity of the building method. The present invention does not require a framework to hold the structure in place, making it easier, quicker and cheaper to use.

One unique aspect of this invention is that the cementitious material is sprayed directly on the structure without the need for wire or other meshing to hold the material, unlike stucco or other conventional materials.

The current art contains a number of spray-on cementitious materials, which have two drawbacks. Many cannot be applied directly to a surface, requiring the use of a wire or mesh covering over the surface. Others can be applied directly to a surface, but provide no structural support. The present invention does both.

Examples of prior art in these categories includes U.S. Pat. No. 4,774,794 issued Oct. 4, 1988 to Grieb, which discloses pre-made foam blocks with a cementitious coating. The coating is applied on a fiberglass reinforcement mat laid over the surface prior to the application of the coating. While these blocks are of sufficient strength to create a load-bearing structure, they have the disadvantage of requiring a mesh to apply the cementitious coating. A similar example is U.S. Pat. No. 4,150,175, issued Apr. 17, 1975 to Heutteman, discloses a building panel made from a honeycombed core panel covered with a thin, strong concrete coating. Both inventions require assembly after coating.

A second unique aspect of the present invention is that the cementitious material dries hard enough to make the material load-bearing. There are many spray-on materials known in the art, such as cement or stucco, but these do not add structural strength or support to the building. There are a few patents on the direct application of cementitious materials to a surface, but none produce a structure that has load-bearing properties. For example, U.S. Pat. No. 4,067,164, issued Jan. 10, 1978 to McMillan, shows a panel with a direct application of cementitious materials, which provides protection to the underlying materials, but does not produce any structural benefits.

Another example from the prior art is U. S. Pat. No. 5,771,649 issued Jun. 30, 1998 to Zwieg. It is drawn to a system of structural foam and plastic blocks, which are then coated with a sprayed on concrete. In Zwieg, the blocks provide structural support and the concrete provides a protective layer.

From the proceeding description of the prior art, it should be apparent that there is a need for a building system that is simple to build, yet structurally sound. This invention meets that need.

SUMMARY OF THE INVENTION

The present invention is directed to a new foam panel building system that is bonded together with a cementitious coating that forms a load-bearing shell around the entire structure, and to the method of constructing this structure. The building system is comprised of a number of foam panels, a means for connecting the panels into wall units and a roof, and a cementitious coating applied directly to the walls and roof which forms a load-bearing shell.

It is an object of the present invention to provide a more easily constructed and more durable building system than that which has previously been available in the industry. Moreover, the present invention provides a building system that is not only strong, but is also aesthetic in appearance. It can be easily adapted to incorporate a great variety of architectural details to suit a purchaser's specific needs. Importantly, the invention also provides a low-cost housing alternative that is quick to construct.

It is an additional object of this invention to provide a cementitious coating that is applied directly to a surface without the need for wire or mesh to hold the coating. It is a further object of this invention that this cementitious coating, once applied to a surface, provides sufficient strength and durability to create a load-bearing structural element.

The method of constructing this structure comprises the steps of building a foundation, attaching panels to create walls, attaching walls to the foundations and then to each other, attaching panels to create a roof, and applying a cementitious coating onto the walls and roof to form a load-bearing shell around the structure.

Still other objects, features, and advantages of the present invention will be apparent from the following description of the preferred embodiments, given for the purpose of disclosure, and taken in conjunction with the accompanying drawings.

DESCRIPTION OF THE PREFERRED EMBODIMENTS

Figure 1:
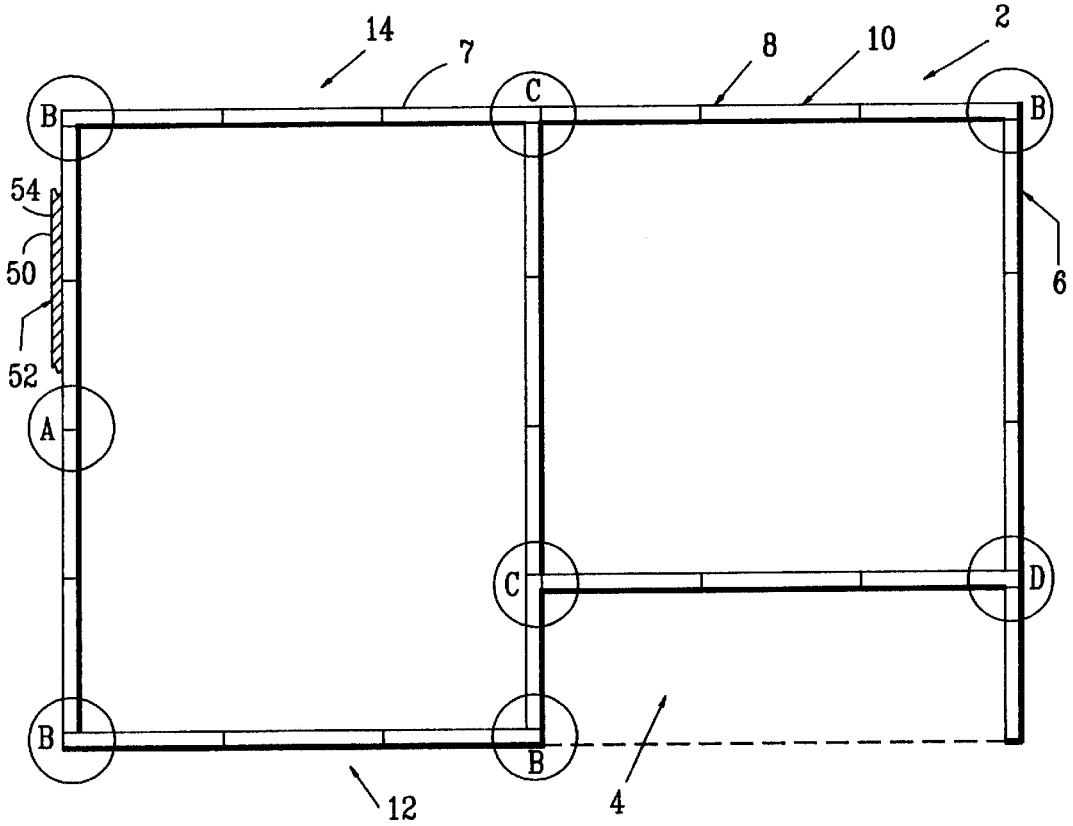
FIG. 1. is a plan view of the preferred embodiment of the building system showing the location of the exterior and interior walls on the foundation.
Figure 2:
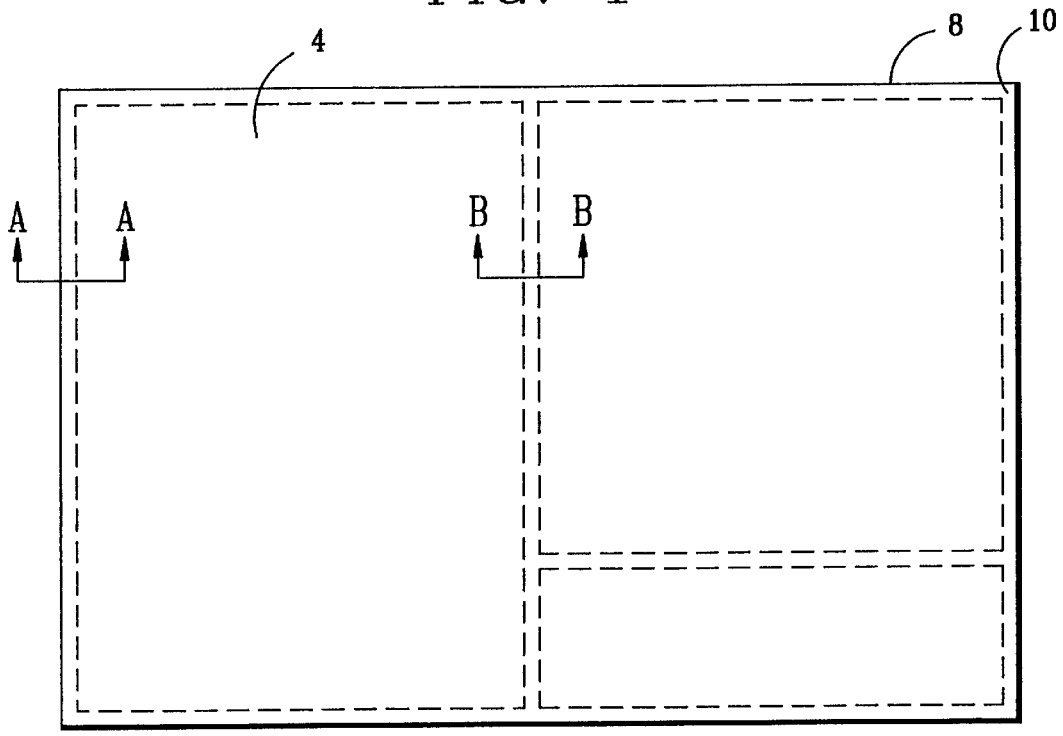
FIG. 2. is a plan view of the foundation showing the location of the trenches under the exterior and interior walls.
Figure 3:
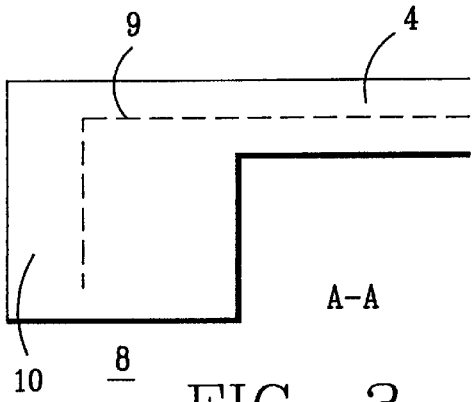
FIG. 3. is a cross-sectional view of the foundation at a cross-section showing the trench at the edge of the foundation beneath the exterior wall.
Figure 4:
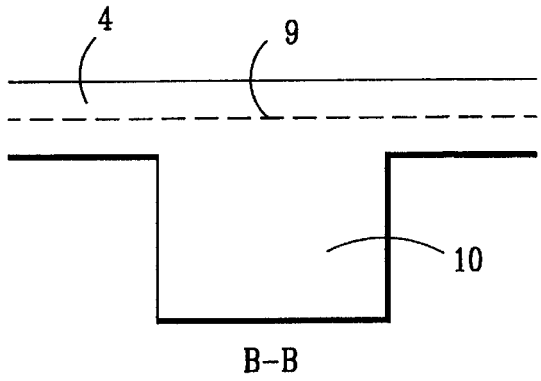
FIG. 4. is a cross-sectional view of the foundation at a cross-section showing the trench under an interior wall.

Referring to the drawings, FIG. 1 shows a preferred embodiment of the present invention where the building system is a house 2 built on a concrete foundation 4 that is preferably a reinforced concrete slab. However, a wide variety of housing foundations may be used, as is well-known to those skilled in the art. In the most preferred embodiment, a welded wire mesh 9, as shown in FIGS. 3 and 4, is used to reinforce the concrete and No. 6 mesh (the wires run perpendicular to each other at about 6 inch intervals). The wire fabric 9 is laid in a grid work pattern and is bent on the ends into a trench 10 that is excavated around the perimeter 8 of the concrete foundation 4, as further shown in FIGS. 2 and 3. The foundation 4, in another preferred embodiment, may be constructed with a system of I-beams placed under the perimeter 8 of the house 2 as well as under the interior walls 5. Concrete is poured around the I-beams.

The dimensions of the concrete foundation 4 should match the dimensions of the house 2 at ground level, plus any porches or patios affixed to the house 2. The dimensions of the foundation 4 may be any size, but in the preferred embodiment of a small house, are about 24 feet by about 20 feet. In addition, the foundation 4 is in the range preferably of about 2 inches to about 6 inches in thickness. In one preferred embodiment of the invention, the concrete foundation 4 is about 2 inches thick across the entire foundation 4, except where trenches 10 are formed around the perimeter 8 of the house 2 and under any walls 6 of the house 2. Preferably, the trenches 10 are about 4 inches deep and about 6 inches wide and create additional support under the walls 6 of the house 2. FIG. 3 shows a cross-section of the trench 10 across the line A—A in FIG. 2. FIG. 4 shows a cross-section of the trench 10 under an interior wall 6 of the house 2 across the line B—B in FIG. 2.

Figure 5:
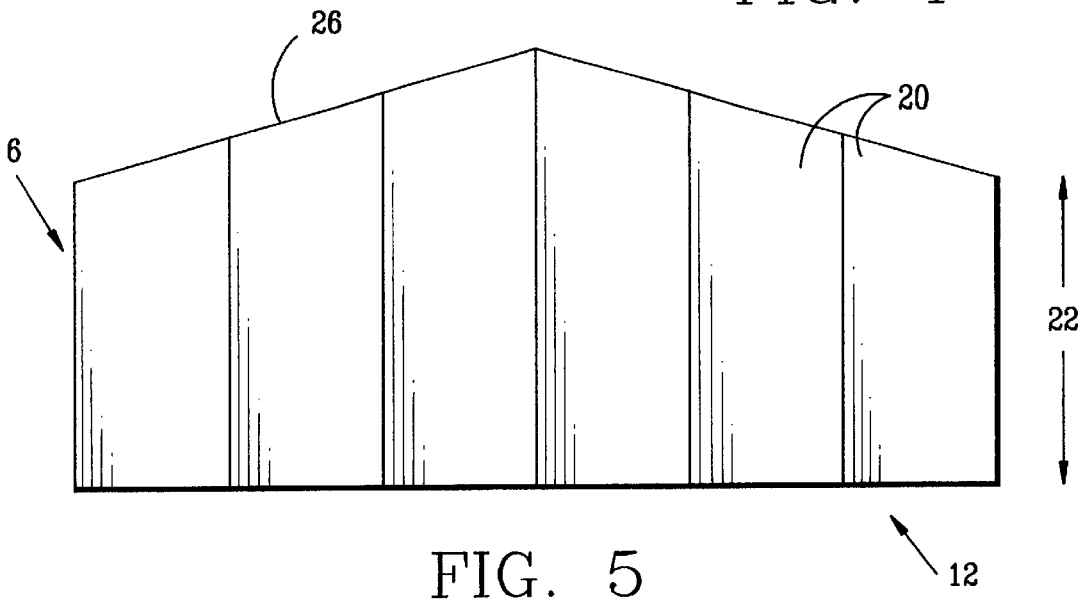
FIG. 5. is the front elevation view of the preferred embodiment showing multiple vertical foam panels positioned side-by-side and cut at a slant to match the pitch of the roof, and joined together to form the front wall.
Figure 6:
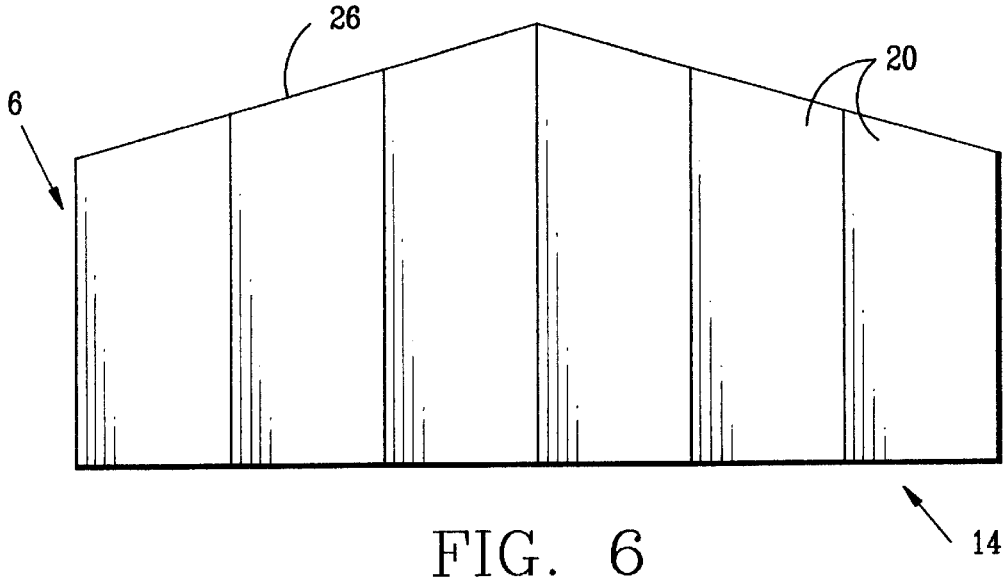
FIG. 6. is the back elevation view of the preferred embodiment showing multiple vertical foam panels positioned side-by-side and cut at a slant to match the pitch of the roof, and joined together to form the back wall.

As shown in FIGS. 5 and 6, the interior walls 5 and exterior walls 6 of the house 2 a re constructed of foam panels 20. The foam panels 20 may be made of expanded polystyrene ("EPS"), polyurethane or other foamed plastics. EPS panels cut to the proper size may be readily obtained from foam companies and are preferably modified EPS with a pound per cubic foot density in the range of about 1.0 to about 2.0 (Houston Foam Plastic, Houston, Tex.). In the preferred embodiment, the foam panels 20 are pre-cut and numbered consecutively so that they are easily assembled at the construction site and easily matched up with the house 2 drawings. The foam panels 20 may be any thickness, but preferably are in the range of about 3 inches to about 6 inches thick and most preferably are 4 inches thick. The foam panels 20 are preferably 4 foot wide rectangular foam panels 20 that are cut to create a length equal to the height 22 of the walls 6.

Figure 7:
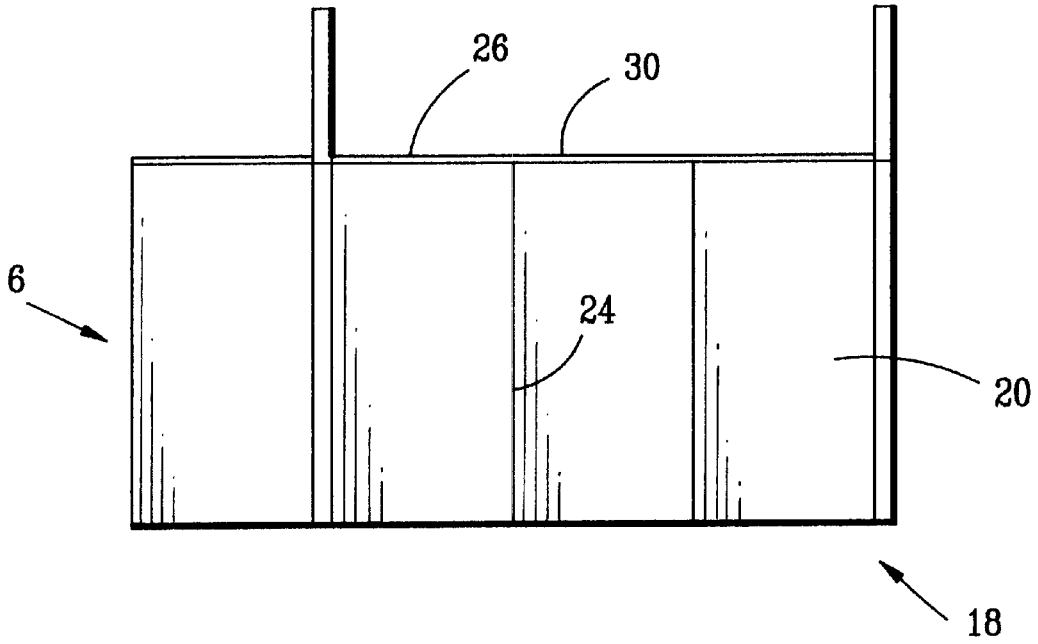
FIG. 7. is the right elevation view of the preferred embodiment showing multiple vertical foam panels positioned side-by-side and joined together to form the right wall.
Figure 8:
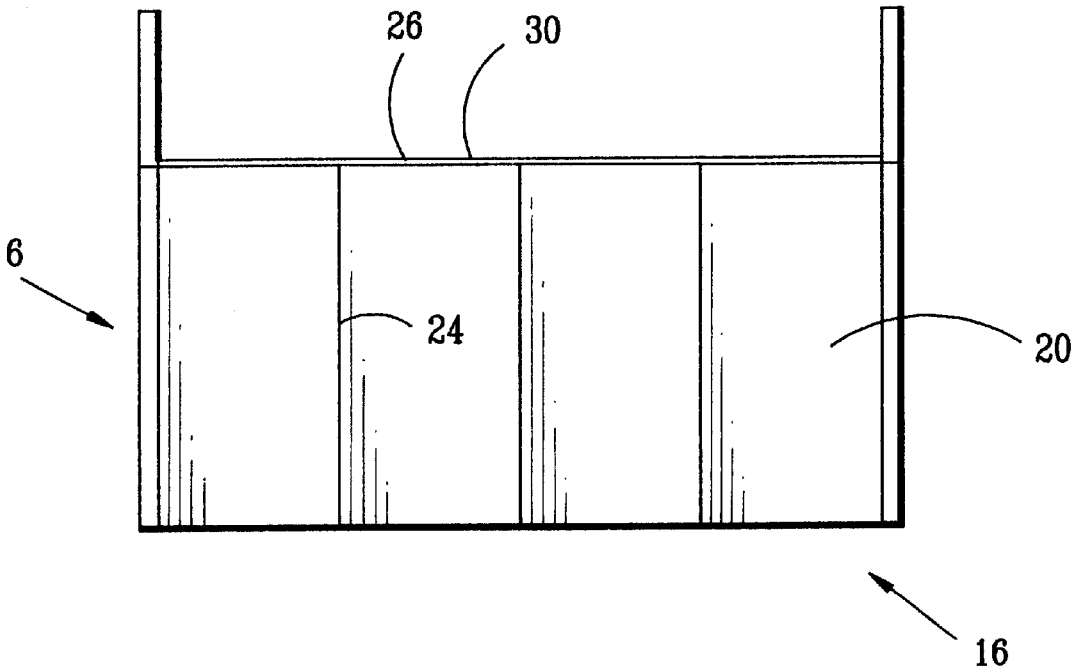
FIG. 8. is the left elevation view of the preferred embodiment showing multiple vertical foam panels positioned side-by-side and joined together to form the left wall.
Figure 16:
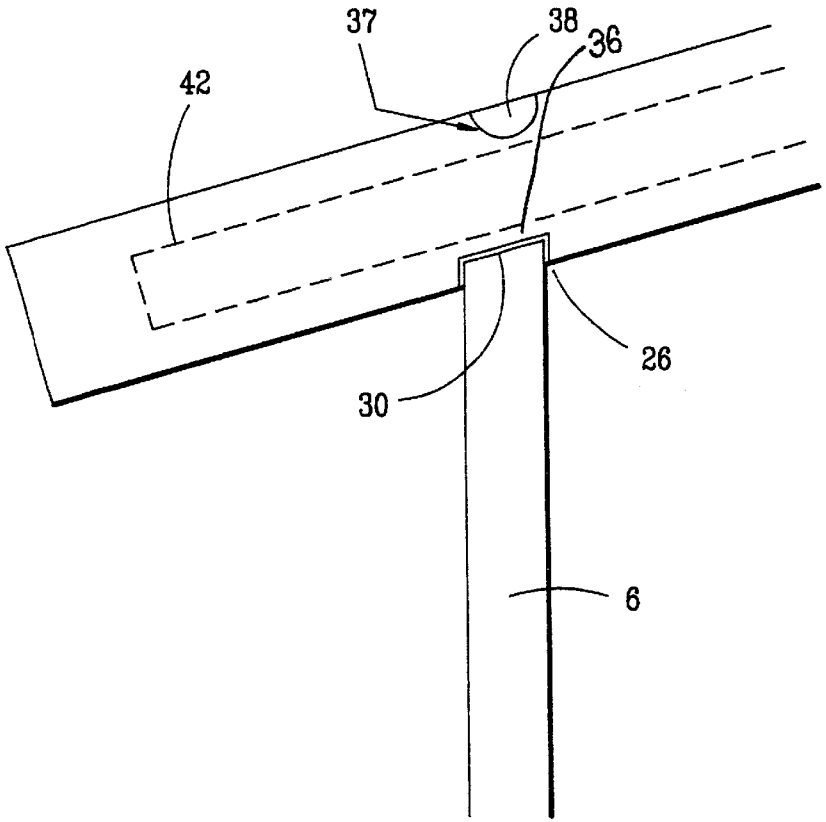
FIG. 16. is a detail view of an alternative embodiment showing the eave, the bevel cut on a wall, a notch cut into the underside of the roof to receive the top edge of the wall, an outer roof notch cut into the upper roof surface with an outer roof rib placed in the outer roof notch, and a spline connecting foam panels of the roof.

Referring to FIGS. 5 and 6, foam panels 20 that are about 4 feet wide fit together side-by-side vertically. The vertical joint 24 between the panels 20 is preferably joined with an adhesive product. However, other means for joining the panels 20 include tape, toothpicks, wood skewers, and other similar devices that may be used to temporarily secure foam pieces. In the preferred embodiment, Enerfoam® (Flexible Products Company of Canada, Inc., Ontario, Canada) is used between the foam panels 20. The foam panels 20 of each wall 6 are glued together and then each wall 6 is glued to the other walls 6. For example, FIG. 5 shows the panels 20 for the front 12 of the house 2 joined together. FIG. 6 shows the glued together panels 20 for the back 14 of the house 2. FIGS. 7 and 8 show the joined panels 20 for the right 18 and left 15 sides of the house 2. In addition, the panels 20 for the front 12 and back 14 are cut on the top edge 26 to match approximately the pitch of the roof 28. In addition, the panels 20 for the left 16 and right 18 walls 6 are beveled 30 (cut on a slant) on the top edge 26 to about the same angle as the pitch of the roof 28, as shown in FIGS. 7, 8, and 16.

In another embodiment of the present invention, the foam panels 20 are juxtaposed one above the other to form walls 6 instead of being juxtaposed vertically side-by-side. The horizontal panels 20 are attached to each other through the means described above.

Interior walls 5 of the house 2 are preferably constructed of the same foam panels 20 as used for the outer walls 6 of the house 2. The foam panels 20 are pre-cut to a length 22 to match the distance from the foundation 4 to the roof 28 of the house 2 at the position where the interior walls 6 are placed. The top edge 26 of each panel 20 is preferably beveled 30 to approximately match the pitch of the roof 28.

Figure 14:
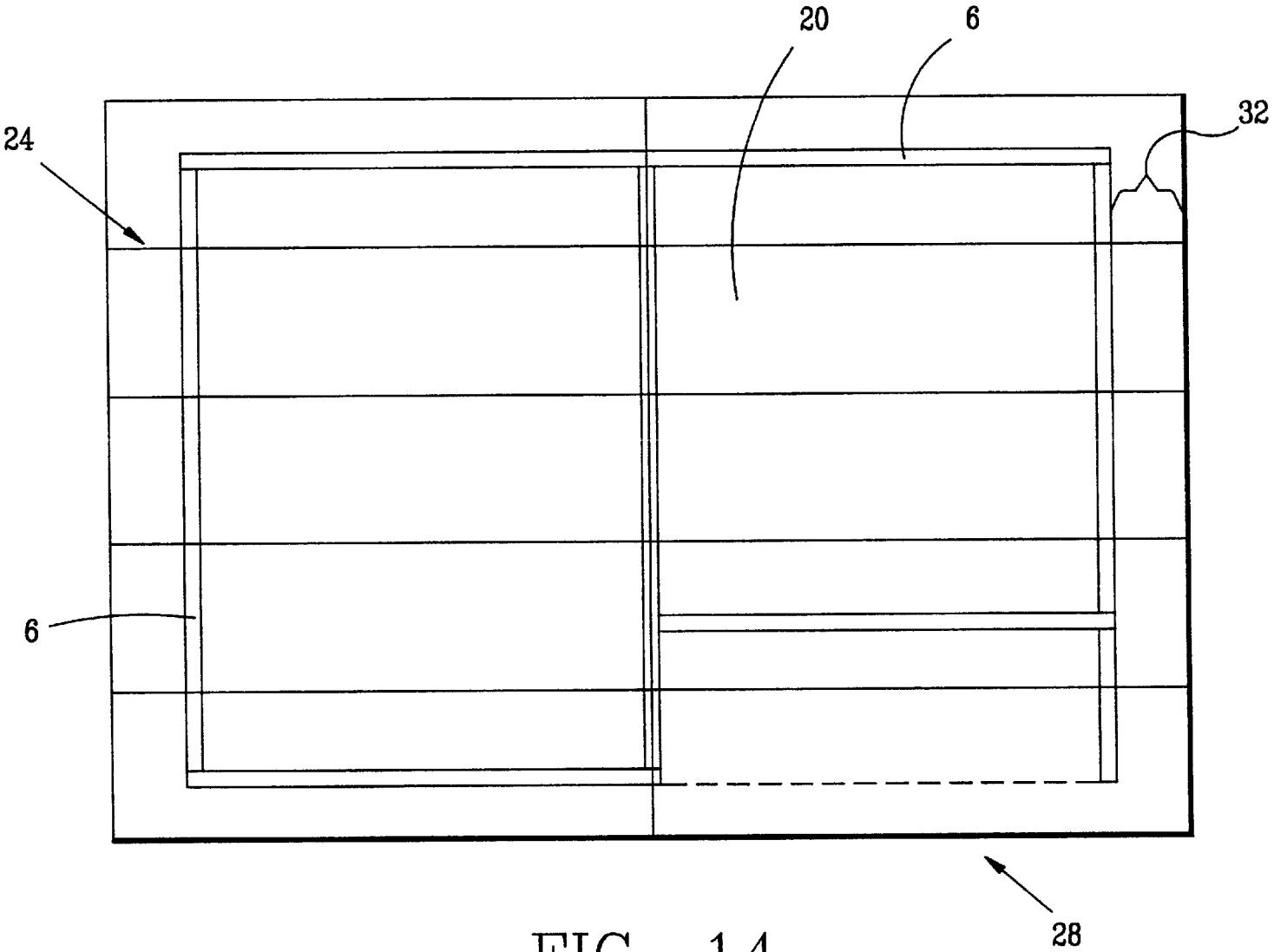
FIG. 14. is a roof plan view of the preferred embodiment showing multiple foam panels positioned side-by-side and joined together to form the roof.
Figure 15:
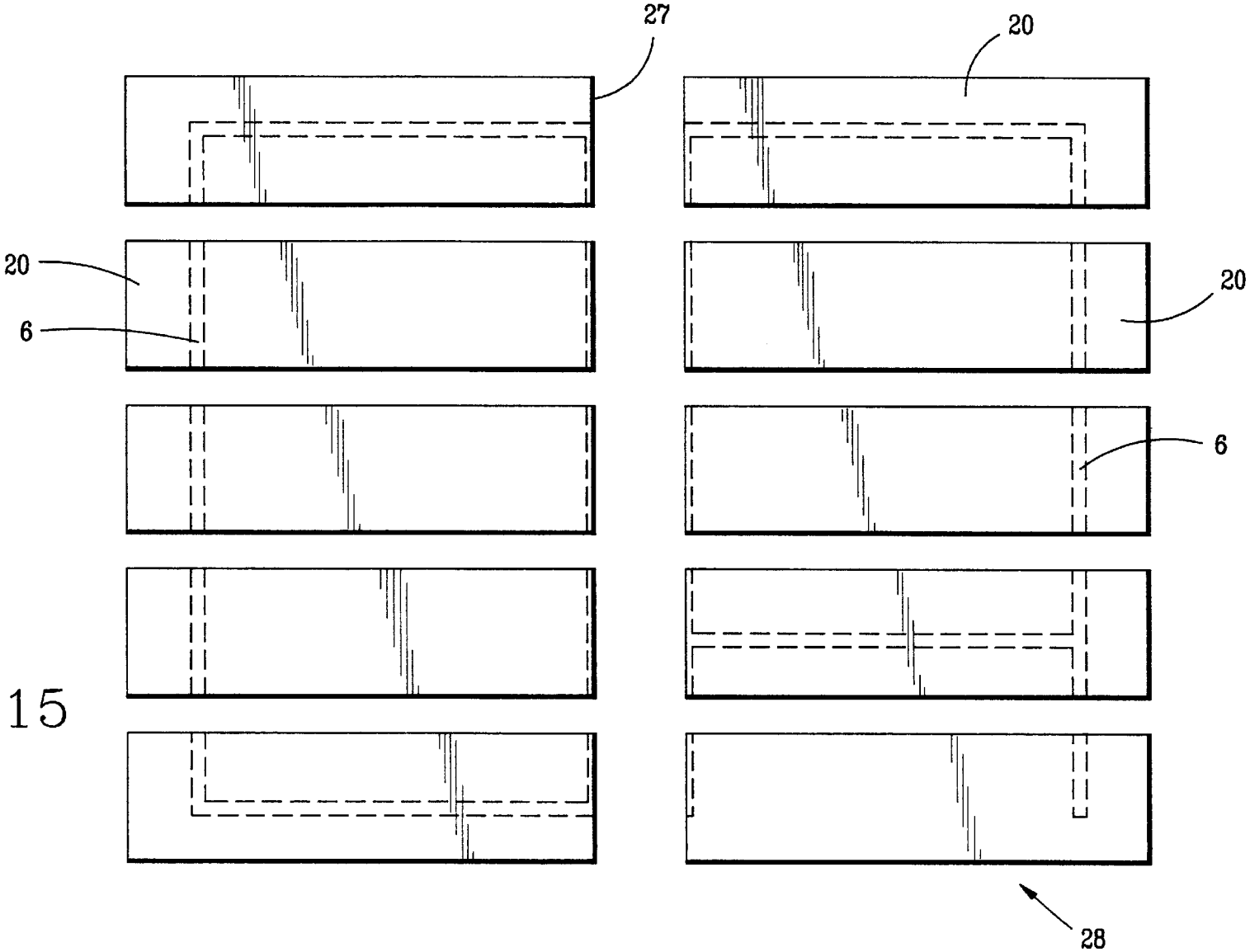
FIG. 15. is a roof plan layout view of the preferred embodiment showing multiple foam panels before being joined.

Referring to FIG. 14, the roof 28 is constructed of foam panels 20 which may be cut in a wide variety of dimensions. In the preferred embodiment, the roof 28 is constructed of rectangular foam panels 20 which are about 8 inches thick, about 4 feet wide, and long enough to allow for about a 2 foot overhang 32 on the left 16 and right 18 sides of the house 2. The roof thickness preferably varies from about 6 to about 12 inches. FIG. 14 shows a top view of the roof 28 where the panels 20 of the roof 28 are superimposed over the walls 6 of the house 2. The roof overhang 32 preferably exists on all sides of the house 2. FIG. 15 shows the same roof 28 layout prior to joining the roof panels 20 together. Preferably, the roof panels 29 for each side 16, 18 of the house 2 are joined together along the vertical joints 24 between the panels 20 with an adhesive material. Further, the top edge 27 of the panels 20 are joined by an adhesive material at the apex 34 of the roof 28.

Figure 17:
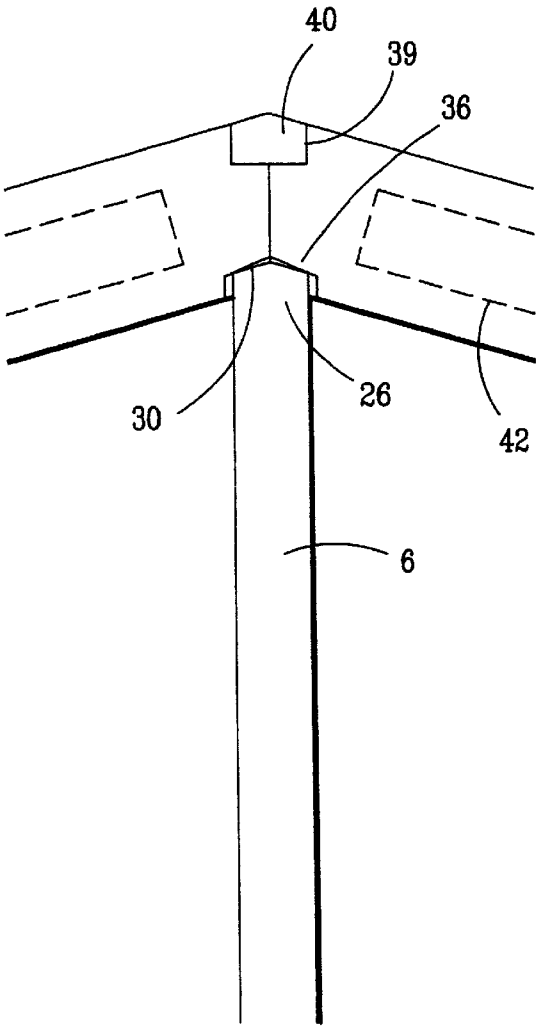
FIG. 17. is a detail view of an alternative embodiment of the ridge of the roof, showing a bevel cut on the top edge of the interior wall, notches cut into the underside of the roof to receive the top edge of the wall, the apex roof notch cut into the apex of the roof, the apex roof rib placed in the apex roof notch, and splines connecting foam panels of the roof.

FIG. 16 shows an alternative embodiment of the invention where the left side 16 and right side 18 of the walls 6 are received on their top edge 26 into a notch 36 cut into the roof panels 20. FIG. 17 shows an embodiment of the invention where an interior wall 6 of the house 2 is positioned under the apex 34 of the roof 28. The roof panels 26 contain a notch 36 that receive the top edge 26 of the wall panels 20.

Figure 18:
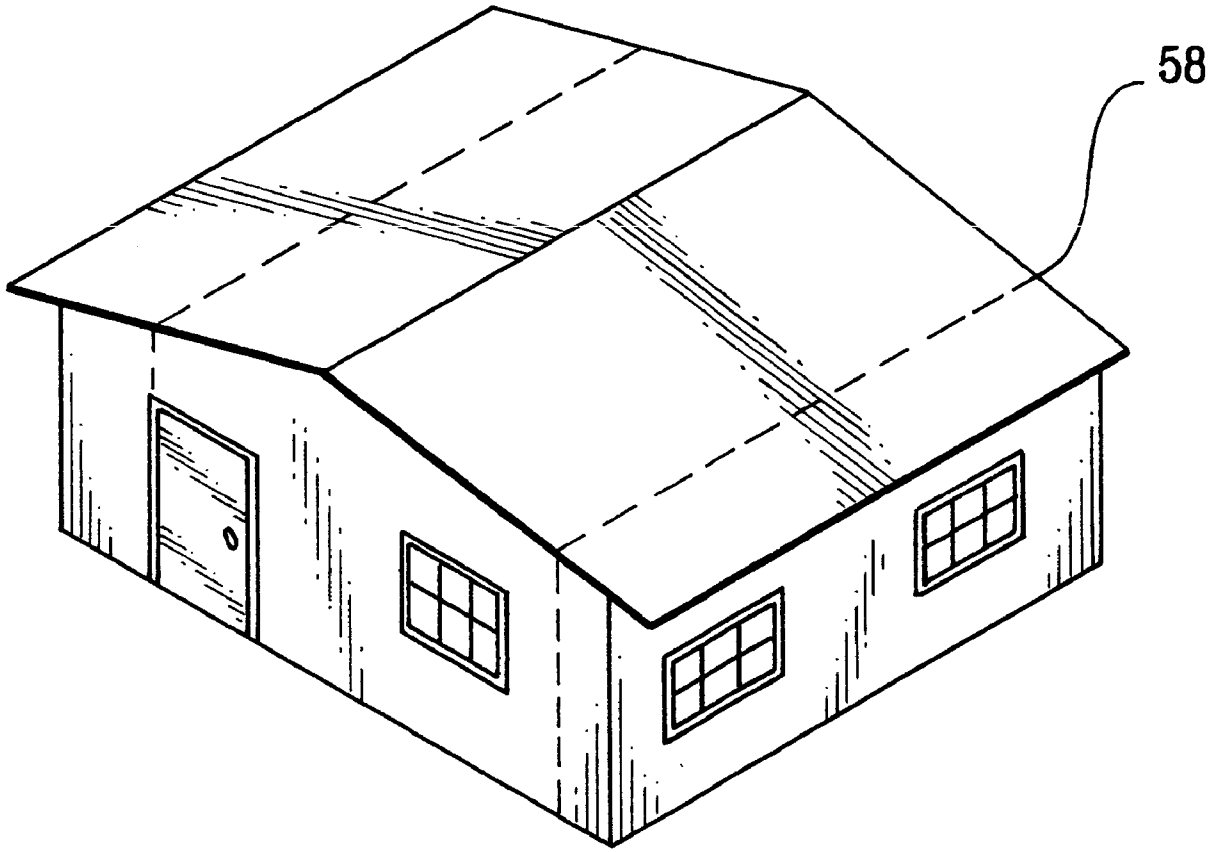
FIG. 18. is a perspective view showing the assembled structure in the alternative embodiment with the hurricane straps and a door and windows.

In another alternative embodiment of the invention, the roof panels 20 are cut with an outer roof notch 37 from the front 12 to the back 14 of the house 2. The outer roof notch 37 is positioned over the walls 6 on the left 16 and right 18 sides of the house 2. The outer roof notches 37 on the left 16 and right 18 sides of the house 2 are then filled with an outer roof rib 38 that is cut to match the shape of the outer roof notches 37. The outer roof rib 38 runs the entire length of the notch 37. In another alternative embodiment of the invention, an apex roof notch 39 is cut along the top edge 27 of the roof panels 20. The dimensions of the notch 39 may vary greatly but are preferably about 2 inches deep and about 2 inches wide to create a combined notch 39 (after the roof panels 20 are joined at their top edge 27 of about 2 inches deep and about 4 inches wide). An apex roof rib 40 is cut to approximately match the shape of the apex roof notch 39. The apex roof rib 40 is placed into the apex roof notch 39 and runs the length of the apex 34 of the roof 28. As shown in FIG. 18, under the ribs 38, 40, a hurricane strap 58 can be placed across the roof 28 and connected to the foundation 4, in an alternative embodiment of the invention. A hurricane strap 58 may be made of a wide variety of materials, but is preferably a thin strap of about 18 or 22 gage steel.

The ridge detail in FIG. 17 shows a roof angle of about 14° from the horizontal (or a 4 to 1 ratio vertical to horizontal). However, the roof angle may be varied from a flat roof to one with a steep pitch.

Figure 9:
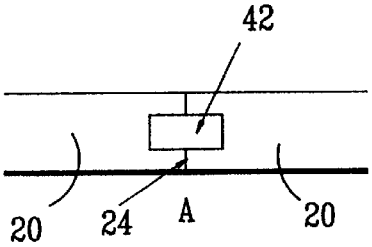
FIG. 9. is a detail view of an alternative embodiment showing the use of a spline as a connection between two adjoining wall panels.
Figure 10:
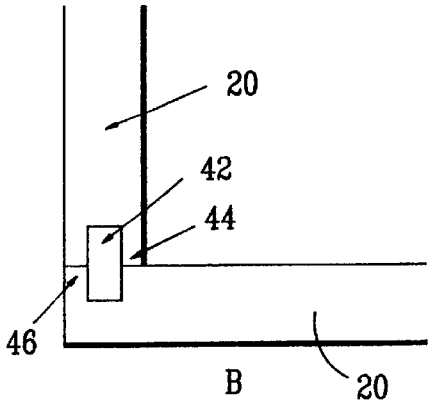
FIG. 10. is a detail view of an alternative embodiment showing the use of a spline as the connection between two adjoining corner wall panels.
Figure 11:
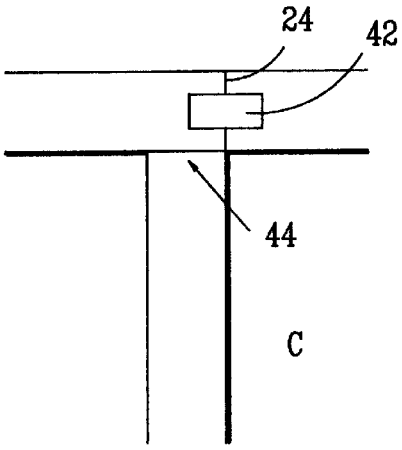
FIG. 11. is a detail view of an alternative embodiment showing the use of a spline as the connection between two adjoining exterior wall panels and an adjoining interior wall panel.
Figure 12:
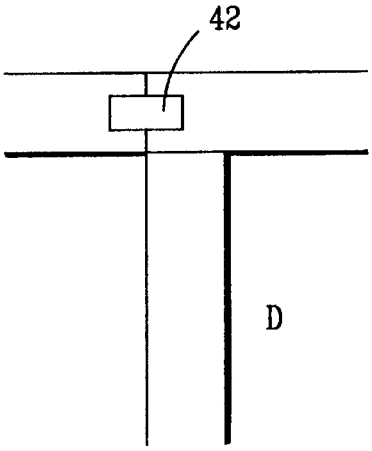
FIG. 12. is a detail view of an alternative embodiment showing the use of a spline as the connection between two adjoining corner wall panels and an adjoining wing wall.

In another preferred embodiment of the invention, some or all of the wall panels 20 may be joined at their vertical joints 24 with splines 42. Accordingly, where all panels 20 in the framework-free building system of the present invention are joined at their vertical joints 24 with splines 42, every panel of the plurality of panels is juxtaposed and connected via a spline 42, such as a foam spline, to two panels 20. Specific spline 42 connections are shown in FIGS. 9, 10, 11 and 12. For example, foam panels 20 having grooves are juxtaposed and connected via a foam spline 42 located in the grooves of juxtaposed panels to create a plurality of walls and a roof. In one embodiment of the present invention, at least one panel 20 has grooves along each of its two opposing edges 24 so that the said at least one panel 20 is juxtaposed and connected via a foam spline to two other panels 20. The shape of the splines 42 may vary greatly, but a spline preferably has a rectangular cross-section and extends most of the length of a panel 20. FIG. 9 is a cross-sectional view of FIG. 1 at A, showing a spline 42 with the cross-sectional dimensions of about 1.5 inches by about 3.5 inches. FIG. 10 shows a cross-sectional view of FIG. 1 at B, where a spline 42 helps connect a wall panel 20 at a comer 48 of the house 2. The spline 42 connects the vertical side or edge 24 of one panel 20 with a side 46 of another panel 20, a comer panel. FIGS. 11 and 12 show alternative embodiments of the invention where three wall panels 20 are joined together. Splines 42 may be used to join one or more of the three wall panels 20 together. Further, the outline of splines 42 joining roof panels 20 is shown in FIGS. 16 and 17. Still further, where at least one panel 20 has grooves along each of its two opposing edges 24 to allow it to be juxtaposed and connected via a spline 42 to two other panels 20, one or both of the two other panels 20 can selected from the group consisting of a corner panel which has a groove along its side 46 (FIG. 10), an interior wall panel that has a groove along its side 46 (FIG. 12), a panel which has a groove along its edge 24 (FIGS. 9 and 11) and a panel which has a groove along each of its two opposing edges 24.

After the walls 6 and roof 28 are constructed, openings for doors, windows, electrical outlets and other features are cut into the foam 20. As seen in a cross-section detail in FIG. 1A., the entire structure 2 is coated inside and out with a cementitious material 50 that forms a load-bearing shell 52 that sticks directly to the foam panels 20.

In other preferred embodiments, architectural details are added to the house 2 such as texture, color, decorative tile or brick, or architectural features that provide the house 2 with contours. Foam trim panels 20, for example may be placed at the corners 48 of the house 2 and around doors and windows to provide architectural contours. Architectural features of great variety may be achieved.

The preferred method of this invention is a new method for constructing a building system 2 without steel or other support systems. Erecting the building system 2 involves first preparing a house site. Traditional methods of site preparation are well-known to those skilled in the art and include leveling of the ground, as well as soil testing. Soil conditions vary significantly such that a geotechnical report is preferably prepared prior to house 2 construction; this involves boring into the soil to a depth of about 10 feet and taking soil samples. Geotechnical tests performed on the soil typically determine compaction and expansion rates for the soil, thus helping to determine house foundation requirements.

Compacted fill is preferably placed on the site to provide a partial vapor barrier between the foundation 4 and the earth. A concrete foundation 4 is then prepared, which is preferably a traditional concrete slab 4. In the preferred embodiment, a trench 10 is dug around the perimeter 8 of the foundation 4 and under the interior walls 6 of the house 2. Referring to FIGS. 3 and 4, cross-sections of the trenches 10 from FIG. 2 are shown across the lines A—A and B—B respectively. Preferably, the trenches 10 are about 4 inches deep, but their depth may be varied greatly. After the trenches 10 are dug, welded wire fabric or reinforced steel 9 is laid on the site. In the most preferred embodiment, welded wire fabric 9 is laid across the foundation 4 area and bent into the perimeter trenches 10. The wire mesh 9 is preferably No. 6 size wire mesh 9 which has wires perpendicular to each other at 6 inch intervals. Ready-mix concrete is preferably poured into the foundation 4, vibrated into place, and floated smooth, as is well-known to those skilled in the art.

In an alternative embodiment, a system of I-beams is laid on the foundation 4 around the perimeter 8 of the house 2 as well as under the interior walls 6. Additional beams may also be placed. Once the beams are placed, concrete is poured over them to create a foundation 4.

In the preferred embodiment, the concrete slab 4 is poured to a depth of 2 inches, except where the trenches 10 exist. The trenches 10 preferably have a total depth of about 6 inches. The slab 4 in the preferred embodiment of a small house 2 is about 24 feet by 20 feet.

Once the foundation 4 has cured, the pre-cut and numbered foam panels 20 are assembled. In one alternative embodiment of the invention, a bottom track 7 is placed on the foundation 4 along the perimeter 8 of the house 2. The bottom track 7 is preferably the same width and diameter as the foam 20 and can be flat or have edges on each side to provide a C-shaped track. The track 7 is preferably glued to the foundation 4. Alternatively, it may be attached with anchor bolts or ramsetted nails. After the bottom tracks 7 are attached, the walls 6 are erected one by one. First, the panels 20 for each wall 6 are joined together, preferably by glue. If a spline 42 is used in the joints 24 between wall panels 20 (as described above), the splines 42 are inserted between the consecutive wall panels 20. Preferably, the splines 42 are made of foam, for example, EPS foam. In one preferred embodiment, the splines 42 and panels 20 are adhered together with a foam adhesive aerosol spray such as Enerfoam®. Once a wall 6 is constructed, it is set onto the bottom track 7, if one is used, and erected using temporary bracing, which bracing is well-known to those skilled in the art. Once the outer walls 6 are erected, the interior walls 6 are erected. After all the walls 6 of the house 2 are assembled and temporarily braced, the roof 28 is assembled. The roof panels 20 are pre-cut and numbered for ease of assembly. In the preferred embodiment, the roof panels 20 are glued together one-by-one on top of the house 2. Preferably, glue such as Enerfoam® is used to help adhere the roof panels 20 to the walls 6 where they meet at the sides 16, 18 of the house 2 and at the apex 34 of the roof 28. Modest temporary bracing, as is well-known to those skilled in the art, is placed under the roof panels 20.

Holes are cut in the walls 6 of the house 2 for doors, windows, electrical circuits, plumbing, and as otherwise needed. In one embodiment, wood frames constructed preferably of 2×4's are installed around the openings for the doors and windows. Openings for windows and other items are then covered with plastic, and then a cementitious material 50 that sticks directly to the foam 20 is sprayed onto the house 2. The cementitious material 50 is prepared in the preferred method by mixing together water, sand, lime, marble particles, Portland cement, fibers, and an adhesive additive. In the most preferred method, about 2 gallons of water is mixed with about 100 pounds of sand. Then, about 2 gallons of water and about 100 pounds of sand are added and mixed. Then, about 60 pounds of marble particles and about 10 pounds of lime are mixed in, followed by about 1 gallon of water and about 94 pounds of Portland cement. Then, about 0.5 pounds of quarter-inch fibers is mixed in, followed by about 1 gallon of water and about two gallons of acrylic latex. Other additives may be mixed in to improve the cement properties, such as a retarder. Further, up to about two more gallons of water may be mixed into the cement, depending on the heat, humidity and viscosity of the cement mix. The sand used in the process is preferably a blend of number three and four sands (about 50% of each) which may be commonly obtained (e.g., Specialty Sand, Houston, Tex.). The lime and marble particles are available from suppliers such as General Terrazo in Houston, Tex. The marble is preferably in particles similar in size to number one size sand. Type one Portland cement is preferably used and can be obtained from concrete companies or hardware stores such as Home Depot. The fibers used are preferably quarter-inch fibrillated polypropylene fibers (Fibermesh, Synthetic Industries, Houston, Tex.). However, the fibers may be made of many materials including fiberglass or other plastics, or metal.

In another embodiment, the cement mixture 50 is comprised of approximately 200 pounds of Masonry sand which is a blend of number three and four sands (about 50% of each); approximately 94 pounds of Type one Portland cement; about 5 gallons of water; approximately 1.5 gallons of MICROGEL™; and about ½ pound quarter-inch fibrillated polypropylene fibers.

This cement mixture 50 is preferably mixed in the mixer of the machine that sprays the cement 50 onto the house 2. In the preferred embodiment, the spraying machine is a mixer/pump such as the Putzmeister P11S Vario Worm Pump (Germany). Other machines that may be used to mix and spray the cementitious coating 50 include the Spray Force® drywall and plastering machine, model Hurricane 350 (Spray Force Manufacturing, Inc., Fresno, Calif.) or the Allentown Powercreter® (Master Builders, Inc., Cleveland, Ohio or Allentown Co., Allentown, Pa.).

The spraying machine has a rubber hydraulic hose (available from Putzmeister) attached to its output that is preferably about 75 feet long. The first approximately 25 feet of the hose has about a 3 inch diameter; the second approximately 25 feet of hose has about a 2 inch diameter; and the last approximately 25 feet of hose has about a 1.5 inch diameter. An adjustable nozzle, such as the type used for stucco or gunnite, is attached to the end of the hose. It preferably has a 3/16 inch to a ¾ inch variable tip diameter.

In addition, an air hose is attached from the spray machine to the nozzle to provide air entrainment into the cement mix 50 as it blows from the nozzle, as is well-known to those skilled in the art. By trial and error, the air pressure and the nozzle tip size are adjusted. Preferably, a nozzle tip size of ⅜ inch is used with about 50 psi of air pressure when the air temperature is 95°; about 45 psi of air at 80°; and about 40 psi at 75°.

Figure 1A:
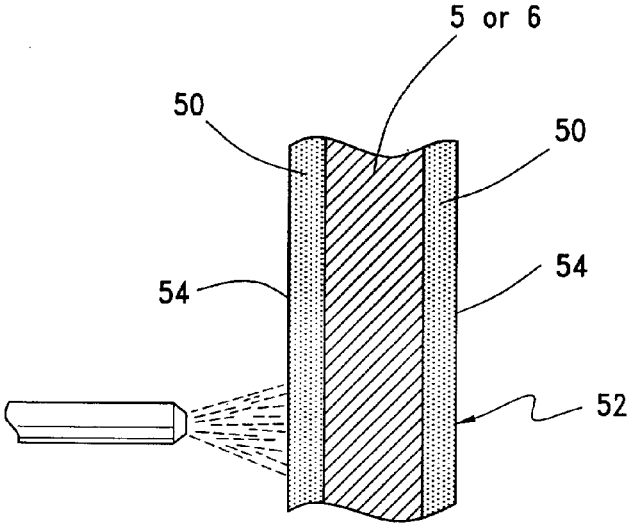
FIG. 1A. is across-sectional view of a wall showing the cementitious material being sprayed in a thin coating to produce the load-bearing shell.

Before the cement 50 is mixed in the spray machine, a primer mixture is made and pumped into the hose. The primer is comprised of about 60 lbs. of lime and about 4 gallons of water, which is mixed for about 3 minutes or until complete mixing occurs. Once the sprayable cement mixture 50 is ready to spray onto the house 2, the primer is pumped into buckets for reuse. Then, the cement mixture 50 is sprayed onto the house 2 in a thin coating 54, as shown in FIG 1A. A single coating 54 in the range of about ¼ inch to about ¾ inch is preferably applied. In the most preferred embodiment, two thin coatings 54 are applied. The first coating 54 is applied to a thickness of about ¼ inch and allowed to cure for about 30 minutes or until a permanent set occurs. Then, a second coating 54 is sprayed on to a thickness of about ¼ inch. The house 2 then cures and attains its final compressive strength as a load-bearing shell 52 around the underlying house materials. In an alternative embodiment, the cement coating 54 is applied by troweling or other non-spray methods. Temporary bracing of the walls 6 and roof 28 is removed once the coating 52 has cured for about three days.

Before the coating 54 dries, it may be decorated by etching patterns into it; by pressing rocks or other appliques into it; by troweling the surface smooth, and by many other decorative techniques. Alternatively, after the cement 54 dries, appliques may be screwed into the cement 54. After the house 2 has cured for about five days, it may be painted or further water sealed. An elastomeric paint such as Hydrostop® accomplishes both water sealing and provides color to the house 2. The paint or sealant is preferably applied by rolling, airless paint gun, or paint brush. In another preferred embodiment of the method, powdered dyes are added to the cementitious material 50 when it is being mixed so that the sprayed cementitious material 50 is in a preferred color, thus obviating any need for painting thereafter.

Before the cementitious material 50 is applied, architectural details can easily be added to the structure around windows, doors, eaves, corners and in other areas by applying additional foam pieces 20 to the walls 6. Such architectural foam pieces 20 may be tooth-picked or glued into placed as described above.

In another preferred embodiment of the invention, an approximately 1 inch by 4 inch wooden strip is attached along the side of the concrete foundation 4. This provides a ledge 56, preferably made of wood, above which the cementitious material 50 is sprayed. The strip is elevated above the ground surface so that shifting ground does not touch the cementitious coating 52. In another alternative embodiment, the foam panels 20 are inset about one inch from the edge of the concrete foundation 4 creating a ledge above which the cementitious material 50 may be sprayed. The cementitious material 50 is then sprayed on the wall panels 20, but not over the concrete foundation 4.

We claim:

1. A framework-free building system comprised of:

a foundation;

a plurality of foam panels, said foam panels juxtaposed to create a plurality of walls and a roof; and a cementitious coating having a thickness of about ¼ inch to about 1 ½ inches applied both inside and outside to said walls and roof to form a load-bearing shell.

2. The framework-free building system of claim 1 wherein said cementitious coating is sprayed or trowelled on.

3. The framework-free building system of claim 1 wherein the foam panels are comprised of expanded polystyrene.

4. The framework-free building system of claim 1 wherein the foam panels are comprised of modified expanded polystyrene with a density in the range of about 1.0 to about 2.0 pounds per cubic foot.

5. The framework-free building system of claim 1 wherein the foam panels are comprised of polystyrene or polyurethane.

6. The framework-free building system of claim 1 wherein the foam panels in said walls have a thickness in the range of about 3 inches to about 6 inches.

7. The framework-free building system of claim 1 further comprising a foam connector between the foam panels, or splines and panels adhered together with an adhesive.

8. The framework-free building system of claim 7 wherein the foam connector is selected from the group consisting of a foam adhesive, a foam spline, a foam spline combined with an adhesive, and a spline combined with a foam adhesive.

9. The framework-free building system of claim 1 wherein the roof pitch has a range from flat to steep.

10. The framework-free building system of claim 1 wherein the foam panels of a gable wall have a slanted top edge to match approximately the pitch of the roof, and the foam panels of a side wall are beveled on the top edge to about the same angle as the pitch of the roof.

11. The framework-free building system of claim 1 wherein the foam panels of the roof have a thickness in the range of about 6 inches to about 12 inches.

12. The framework-free building system of claim 1 wherein the roof extends out over the exterior walls to create an overhang.

13. The framework-free building system of claim 1 further comprising a notch in an underside of the roof panels to correspond to the walls, wherein the notch receives two sides of the walls on their top edge and the roof panels are glued to the wall panels.

14. The framework-free building system of claim 1 wherein a top side of the roof has outer roof notches to receive hurricane straps that connect to the foundation.

15. The framework-free building system of claim 14 wherein outer roof ribs are placed in the outer roof notches.

16. The framework-free building system of claim 1 wherein the foam panels are connected side by side thereby creating vertical joints with foam splines, and glued together.

17. The framework-free building system of claim 16 wherein the foam panels are joined at their vertical joints with foam splines and glued together.

18. The framework-free building system of claim 17 wherein said splines extend most of the length of the foam panels.

19. The framework-free building system of claim 1 wherein the foundation has a bottom track attached to the perimeter of said foundation to receive a bottom edge of the wall panels, wherein the wall panels are polystyrene.

20. The framework-free building system of claim 1 wherein the cementitious material is comprised of water, sand, lime, marble particles, Portland cement, fibers, and an adhesive additive.

21. The framework-free building system of claim 1 further comprising a wood ledge attached to one or more sides of the foundation wherein the wood ledge forms a barrier above which the cementitious material is sprayed.

22. A method of constructing a framework-free building comprising the steps of:

constructing a foundation;

juxtaposing foam panels to form a structure having walls and a roof; and applying a cementitious coating having a thickness of from about ¼ inch to about 1 ½ inches onto the inside and the outside of the walls and roof to form a load-bearing shell around the structure.

23. The method of constructing a framework-free building of claim 22 further comprising the steps of pre-cutting and numbering consecutively the foam panels for assembly at the construction site.

24. The method of constructing the framework-free building of claim 22 further comprising the steps of placing a bottom track on the foundation along the perimeter of the foundation and gluing the walls into the bottom track before the step of applying a cementitious coating.

25. The method of constructing a framework-free building of claim 22 wherein the step of applying the cementitious material is by spraying or by troweling.

26. The method of constructing a framework-free building of claim 22 further comprising the step of etching decorative patterns into the cementitious coating before it dries.

27. The method of constructing the framework-free building of claim 22 further comprising the step of adding powdered dyes to the cementitious coating while it is being mixed.

28. A framework-free building system comprising:

a foundation having a bottom track on the foundation to receive the bottom edge of a foam panel wall;

a structure comprising a plurality of foam panels, said foam panels juxtaposed to create a plurality of walls at least comprising exterior walls and a roof, the roof comprising a notch in an underside of the roof panels to correspond to the walls, wherein the notch receives the top edge of the walls and the roof panels are glued to the wall panels; and a cementitious coating applied to said walls and roof to form a loadbearing shell, wherein said foam panels are connected by foam splines.

29. The framework-free building system of claim 28 wherein said foam panels and said foam splines are made of polystyrene.

30. The framework-free building system of claim 28 wherein interior walls are formed in the structure which comprise foam panels pre-cut to a length to match the distance from the foundation to the roof of the structure at a position where the interior walls are placed.

31. The framework-free building system of claim 28 wherein the foundation is a concrete foundation.

32. The framework-free building system of claim 1 wherein the foundation is a concrete foundation.

33. The method of constructing a framework-free building of claim 22 wherein the foundation is a concrete foundation.

34. The framework-free building system of claim 8 wherein the foam spline is a polystyrene foam spline.

35. The framework-free building system of claim 8 wherein the foam adhesive is a polyurethane foam adhesive.

36. The framework-free building system of claim 1 having interior walls which comprise foam panels pre-cut to a length to match the distance from the foundation to the roof at a position where the interior walls are placed.

37. A framework-free building system consisting essentially of:

a foundation;

a plurality of foam panels, said foam panels juxtaposed and connected via a foam connector to create a plurality of walls and a roof; and a cementitious coating applied both inside and outside to said walls and roof to form a load-bearing shell.

38. The framework-free building system of claim 37 wherein the foam connector is selected from the group consisting of a foam adhesive, a foam spline and a foam spline combined with an adhesive.

39. The framework-free building system of claim 37 wherein the foundation has a bottom track attached on said foundation to receive a bottom edge of the wall panels.

40. The framework-free building system of claim 39 wherein the said bottom track is a C-shaped, flat track having vertical edges on each side.

41. The framework-free building system of claim 37 wherein the foundation is a concrete foundation.

42. A framework-free building system comprising:

a plurality of foam panels, said foam panels having grooves and being juxtaposed and connected via a foam spline located in the grooves of juxtaposed panels to create a plurality of walls and a roof, wherein at least one panel has grooves along each of its two opposing edges so that said at least one panel is juxtaposed and connected via a foam spline to two other panels.

43. The framework-free building system of claim 42, wherein one or both of said two other panels is selected from the group consisting of a corner panel which has a groove along its side, an interior wall panel that has a groove along its side, a panel which has a groove along its edge, and a panel which has a groove along each of its two opposing edges.

44. The framework-free building system of claim 42, wherein every panel of said plurality of panels is juxtaposed and connected via a foam spline to two panels.

45. The framework-free building system of claim 42, wherein said plurality of panels are pre-cut and consecutively numbered.

46. The framework-free building system of claim 42 wherein the foam spline is glued to the foam panels with an adhesive which comprises a foam.

47. The framework-free building system of claim 42 further comprising a concrete foundation.

48. The framework-free building system of claim 47 wherein the foundation has a bottom track attached on said foundation to receive a bottom edge of the panels of the walls.

49. The framework-free building system of claim 48 wherein said bottom track is a C-shaped, flat track having vertical edges on each side.

50. The framework-free building system of claim 42 further comprising a notch in an underside of the roof panels to correspond to the walls, wherein the notch receives two sides of the walls on their top edge and the roof panels are glued to the wall panels.

51. The framework-free building system of claim 42 wherein an interior wall is positioned under the roof at an apex of the roof and further wherein the roof panels forming said apex of the roof contain a notch that receives the top edge of said interior wall.

52. The framework-free building system of claim 47 having interior walls which comprise foam panels pre-cut to a length to match the distance from the foundation to the roof at a position where the interior walls are placed.

53. The framework-free building system of claim 51 wherein said roof panels further comprise an apex roof notch along their top edge, and an apex roof rib is placed into the roof notch and runs along the length of the apex of the roof.

54. The framework-free building system of claim 51 wherein a cementitious coating is applied directly to the inside and outside of the wall panels and roof panels to form a load bearing shell.

* * * * *

UNITED STATES PATENT AND TRADEMARK OFFICE

CERTIFICATE OF CORRECTION

PATENT NO. : 6,460,302 B1
DATED : October 8, 2002
INVENTOR(S) : Neuhaus et al.

It is certified that error appears in the above-identified patent and that said Letters Patent is hereby corrected as shown below:

Column 5,
Lines 49-67, delete and insert the following:
-- FIG. 16 shows an alternative embodiment of the invention where the left side 16 and right side 18 of the walls 6 are received on their top edge 26 into a notch 36 cut into the roof panels 20. FIG. 17 shows an embodiment of the invention where an interior wall 6 of the house 2 is positioned under the apex 34 of the roof 28. The roof panels 20 contain a notch 36 that receive the top edge 26 of the wall panels 20. Notch 36, as shown in FIG. 16, is made one inch deep into roof panels 26 to receive the top edge 26 of wall panels 20, which have bevel 30. Also shown in FIG. 16 and FIG. 17, a 2-inch by 4-inch foam roof spline 42, preferably constructed of a EPS foam, is used to join roof panels 26 along their side edges. Each roof panel 26 is notched to accommodate spline 42. --.

Column 6,
Lines 1-11 delete and insert the following:
-- In another alternative embodiment of the invention, the roof panels 20 are cut with an outer roof notch 37 from the front 12 to the back 14 of the house 2. The outer roof notch 37 is positioned over the walls 6 on the left 16 and right 18 sides of the house 2. As shown in FIG. 16, the outer roof notch 37 is semi-circular and has a 3-inch diameter. The outer roof notches 37 on the left 16 and right 18 sides of the house 2 are then filled with an outer roof rib 38 that is cut to match the shape of the outer roof notches 37. The outer roof rib 38 runs the entire length of the notch 37. In another alternative embodiment of the invention, an apex roof notch 39 is cut along the top edge 27 of the roof panels 20. The dimensions of the notch 39 may vary greatly but are preferably about 2 inches deep and about 2 inches wide to create a combined notch 39, after the roof panels 20 are joined at their top edge 27, of about 2 inches deep and about 4 inches wide. An apex roof rib 40 is cut to approximately match the shape of the apex roof notch 39. The apex roof rib 40 is placed into the apex roof notch 39 and runs the length of the apex 34 of the roof 28. As shown in FIG. 18, under the ribs 38, 40, a hurricane strap 58 can be placed across the roof 28 and connected to the foundation 4, in an alternative embodiment of the invention. A hurricane strap 58 may be made of a wide variety of materials, but is preferably a thin strap of about 18 or 22 gauge steel. --

UNITED STATES PATENT AND TRADEMARK OFFICE

CERTIFICATE OF CORRECTION

PATENT NO. : 6,460,302 B1
DATED : October 8, 2002
INVENTOR(S) : Neuhaus et al.

It is certified that error appears in the above-identified patent and that said Letters Patent is hereby corrected as shown below:

Column 9,
Between lines 62 and 62, insert the following paragraphs:
-- Although the description of the preferred invention is directed to a small house, the building system may be used in many applications. For example, the building system may be used for sheds, barns, boat houses, large houses and commercial buildings.

Common engineering elements such as pumps, gages, valves, controllers, material selection and the like are not shown or described except when necessary for the understanding of the invention, since for the most part, selection and placement of such equipment is well within the skill of the ordinary engineer. Although the above method and apparatus are described in terms of the above preferred embodiments, those skilled in the art will recognize that changes in the process and apparatus may be made without departing from the spirit of the invention. Such changes are intended to fall within the scope of the following claims. --.

Signed and Sealed this

First Day of April, 2003

JAMES E. ROGAN
*Director of the United States Patent and Trademark Office*

UNITED STATES PATENT AND TRADEMARK OFFICE

CERTIFICATE OF CORRECTION

PATENT NO. : 6,460,302 B1
DATED : October 8, 2002
INVENTOR(S) : Neuhaus et al.

It is certified that error appears in the above-identified patent and that said Letters Patent is hereby corrected as shown below:

Title page,
Item [75], Inventors, "Peter Zosh, III" should read -- Peter Zoch, III --; and below Item [75], ABSTRACT, "54 Claims, 8 Drawing Sheets" should read
-- 54 Claims, 9 Drawing Sheets --.

Drawings,
"Sheets 1-8" should be -- Sheets 1-9 --.
Add the Drawing Sheet 2 of 9, consisting of Fig. 1A, as shown on the attached page.

Column 3,
Line 16, "across-sectional" should be -- a cross-sectional --.

Column 4,
Line 50, "a re" should be -- are --.

Figure 13:
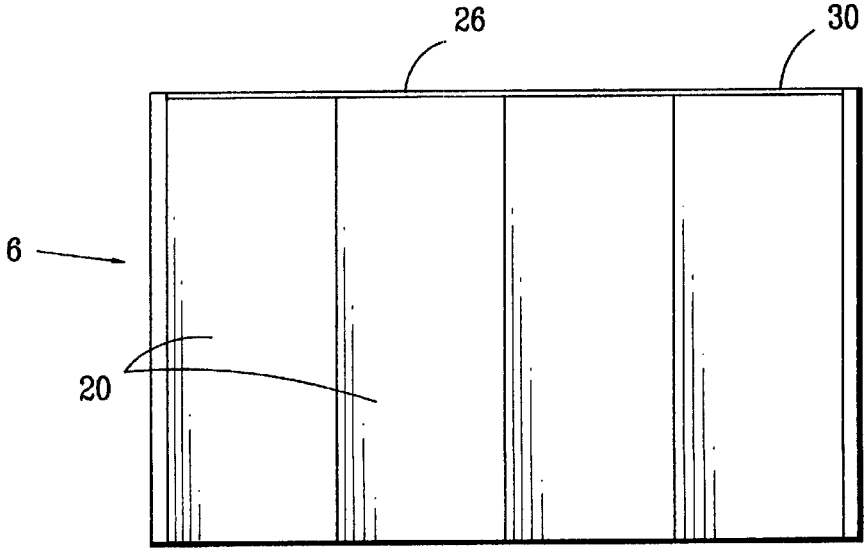
FIG. 13. is an interior elevation view of the preferred embodiment showing multiple vertical foam panels positioned side-by-side and joined together to form a wall.

Column 5,
Delete lines 24-31, and insert the following:

-- As shown in FIGS. 1 and 13, interior walls 5 of the house 2 are preferably constructed of the same foam panels 20 as used for the outer walls 6 of the house 2. The foam panels 20 are pre-cut to a length 22 (FIG. 5) to match the distance from the foundation 4 (FIG. 1) to the roof 28 (FIG. 14) of the house 2 at the position where the interior and exterior walls 6 are placed. As shown in FIGS. 7, 8, and 13, the top edge 26 of each panel 20 is preferably beveled 30 to approximately match the pitch of the roof 28. --.

Signed and Sealed this

Fifteenth Day of April, 2003

JAMES E. ROGAN
*Director of the United States Patent and Trademark Office*